United States Patent [19]

Roosild et al.

[11] 4,005,327

[45] Jan. 25, 1977

[54] LOW BEAM VELOCITY RETINA FOR SCHOTTKY INFRARED VIDICONS

[75] Inventors: Sven A. Roosild, Framingham; Freeman D. Shepherd, Jr., Chelmsford; Andrew C. Yang, Concord, all of Mass.

[73] Assignee: The United States of America as represented by the Secretary of the Air Force, Washington, D.C.

[22] Filed: Oct. 28, 1975

[21] Appl. No.: 625,799

[52] U.S. Cl. ..... 313/367; 313/388; 315/10

[51] Int. Cl.[2] ..... H01J 29/45; H01J 31/49

[58] Field of Search ..... 313/392, 367, 366, 388; 357/31

[56] References Cited

UNITED STATES PATENTS

| | | | |
|---|---|---|---|
| 3,676,715 | 7/1972 | Brojdo | 357/31 |
| 3,703,669 | 11/1972 | London | 313/367 X |

*Primary Examiner*—Robert Segal

*Attorney, Agent, or Firm*—Joseph E. Rusz; Henry S. Miller

[57] ABSTRACT

A solid state sensing retina for infrared vidicon television camera tubes using a low voltage electron beam, consisting of a monolithic silicon wafer having an n-type substrate and two dimensional array of p-type islands, each island has a Schottky electrode photoemitter and substrate contact buss, an ohmic contact pad allows charging of the p-type region beneath the Schottky electrode.

6 Claims, 4 Drawing Figures

FIG. 3
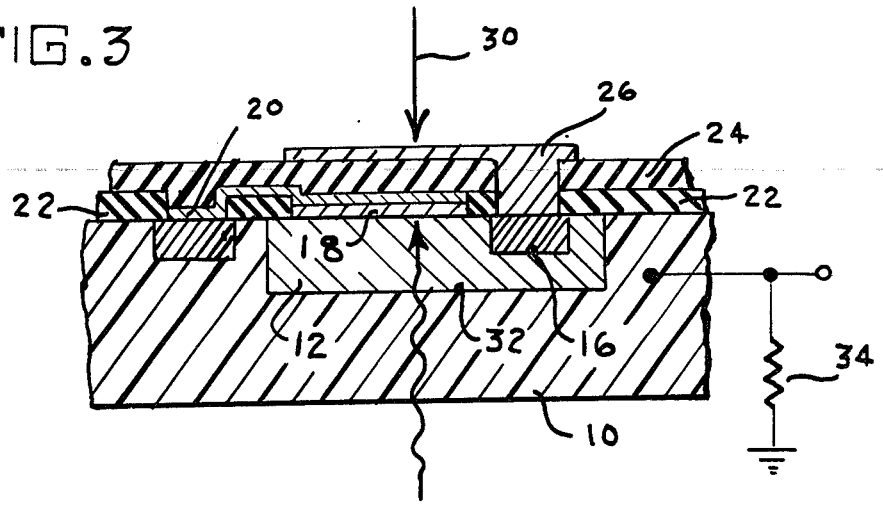
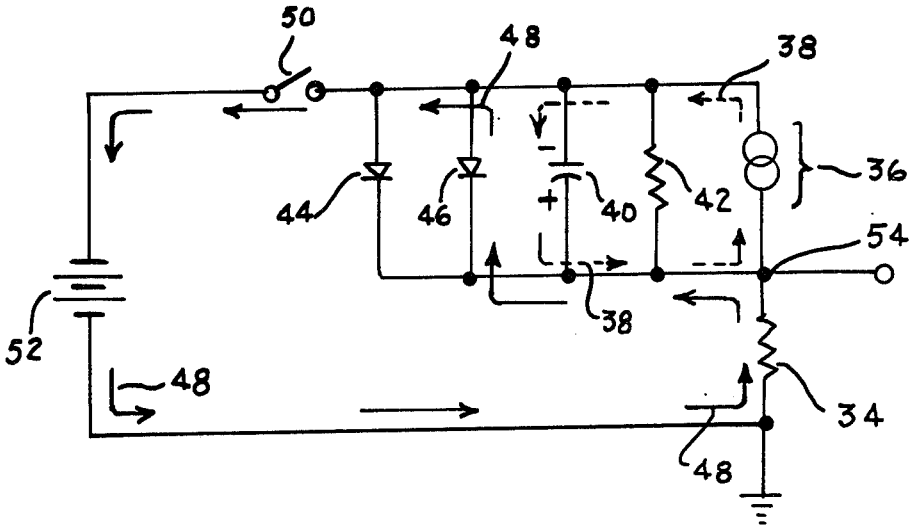
FIG. 4

LOW BEAM VELOCITY RETINA FOR SCHOTTKY INFRARED VIDICONS

STATEMENT OF GOVERNMENT INTEREST

The invention described herein may be manufactured and used by or for the Government for governmental purposes without the payment of any royalty thereon.

BACKGROUND OF THE INVENTION

This invention relates generally to infrared vidicon television camera tubes and more specifically to a solid state retina structure used as a sensing layer in such tubes.

Advances in the art of infrared detection have created increasingly sophisticated and costly equipment. Some of the aforesaid equipment, while capable of achieving superlative results in the laboratory has lacked utility in the field.

The original infrared image converter tube was of simple design and consisted of a photocathode capable of emitting electrons, a phosphor screen and an electron lens system for focusing the emitted electrons on the screen. The wavelength range to which the tube is sensitive depended upon the spectral response of the photocathode. Subsequent devices utilized rare and hard to produce compounds combined with moving optics. Deficiencies in the prior art were cured to some extent, however new problems were created by way of short operational lifetime, difficulty in uniformity in the manufacturing process and a high cost factor.

Recent advances in the art have shown that solid state systems are capable of providing more and better information in a much more reliable manner than any prior known devices. Infrared sensing systems employing an array of solid state detectors such as the Schottky barrier diode fulfill most requirements for infrared detection in the spectral band from 1 micrometer to 6 micrometers in wavelength. These devices, however, when utilized in an infrared vidicon television camera tube have required a high velocity electron gun. The high velocity electrons charge the metal electrodes positive by operating at landing voltages above the secondary emission cross-over point. The use of a high velocity read-out required complex tubes which are expensive, difficult to control and subject to excess noise mechanisms which degrade imagery. The apparatus and system to be described uses conventional low velocity electron gun to place a negative charge on the substrate, thereby eliminating the requirement for high velocity operation, simplifying the camera, lowering costs and improving reliability.

SUMMARY OF THE INVENTION

The invention involves a monolithic silicon wafer forming a solid state retina in an infrared vidicon television camera tube. This structure will allow infrared imaging of persons and machines using a television camera without moving parts. The monolithic silicon wafer has an n-type substrate with a two dimensional array of p-type islands. Each p-type island is contacted by a metal Schottky electrode which acts as an infrared photoemitter. This electrode and its substrate contact buss are shielded from the electron beam by a suitable insulator. Each p-island also has an ohmic contact pad that is exposed to the electron beam to allow negative charging of the p-type semi-conductor region beneath the Schottky electrode.

The utilization of the insulated Schottky electrode, with the p-islands and p-island contact allows read-out of low barrier p-type Schottky retinas with a low velocity electron beam.

It is therefore an object of the invention to provide a new and improved vidicon television camera tube.

It is another object of the invention to provide a new and improved vidicon television camera tube that will image infrared scenes in the spectral band ranging from 1 micrometer to 6 micrometers in wavelength.

It is a further object of the invention to provide a new and improved infrared vidicon television camera tube that utilizes low velocity electron guns.

It is still another object of the invention to provide a new and improved infrared vidicon television camera tube that is simpler than any known like device.

It is still a further object of the invention to provide a new and improved infrared vidicon television camera tube that is low in cost.

It is another object of the invention to provide a new and improved infrared vidicon television camera tube that is highly reliable.

It is another object of the invention to provide a new and improved infrared vidicon television camera tube that operates over a wider range of wavelengths than any known similar device.

It is another object of the invention to provide a new and improved infrared vidicon television tube that is more easily controlled and less effected by degrading noise than other similar tubes.

These and other advantages, features and objects of the invention will become more apparent from the following description taken in connection with the illustrative embodiment in the accompanying drawings.

DESCRIPTION OF THE DRAWINGS

FIG. 3 is a detailed side view of a section of the invention.

FIG. 4 is an equivalent electrical circuit of the invention.

DESCRIPTION OF THE PREFERRED EMBODIMENT

Figure 1:
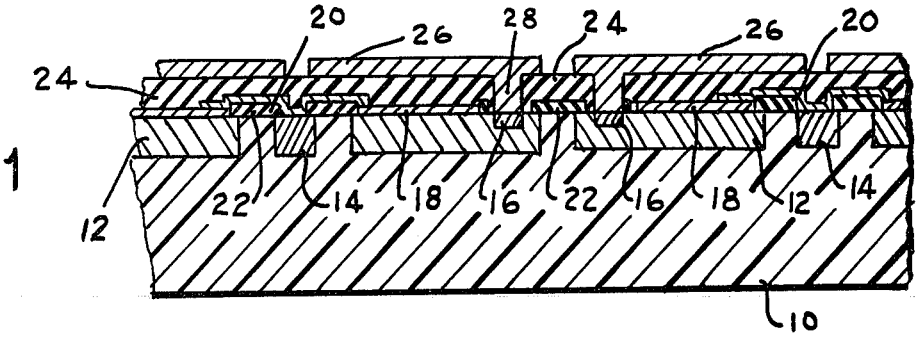
FIG. 1 is a crossectional view of the invention.

Concerning FIG. 1, the low velocity vidicon retina is a monolithic integrated circuit that sits in the focal plane of the infrared television camera. The retina contains a two dimensional array of photocells where each cell consists of a Schottky photocathode on a p-type semiconductor island and p-island electron beam contact pads.

The monolithic substrate of silicon or other suitable material is shown at 10. High resistivity p-type silicon islands 12 are formed for each cell of the vidicon focal plane array. This may be accomplished by alternative methods, such as ion implanting p-type impurities through an oxide or metal mask into a high resistivity n-type substrate, or by an oxide defined $n^+$ isolation diffusion of a p-type epitaxial layer that has been grown onto an n-type substrate.

When the p-type islands 12 are formed by the ion implantation process, then the diffusion of $n^+$ regions 14 for substrate contact and the ion implantation damage anneal can be performed simultaneously. Where the epitaxial approach has been taken, the isolation diffusion provides the substrate contact.

Ohmic contacts 16 are provided to the p-type islands by either alloying defined aluminum bars or by applying an oxide of masked $p^+$ diffusion. The Schottky barrier metal 18 is applied to the p-type island and connected to the $n^+$ regions 14 by a metallic connector 20 which extends over the thermally grown silicon oxide regions 22. The entire vidicon array is covered by a dielectric 24 which is of sufficient thickness to prevent penetration to the Schottky barrier of low velocity electrons and to give good electrical insulation from the metal overlay 26 placed on top of the dielectric (24). A contact opening is etched through the dielectric to allow the metal overlay extension 28 to reach the p-region ohmic contacts 16.

Figure 2:
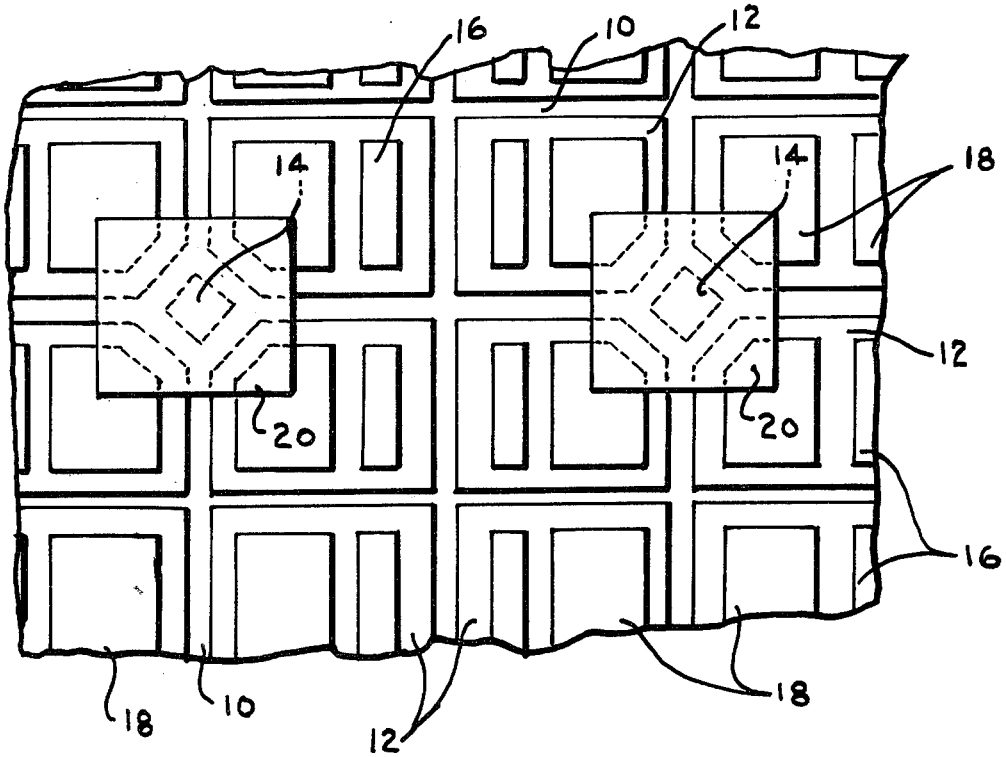
FIG. 2 is a plan view of the invention.

FIG. 2 shows a representative section of the top layout of the vidicon focal plane array made by ion implantation of the p-type islands. The insulating layer that covers the surface (shown as 24 in FIG. 1) has been removed as well as the metal layer (26) in order to more clearly show the position of the materials in the substrate.

The substrate 10 as shown in the figure forms regions to isolate the p-type islands. Schottky barrier metal 18 covers a substantial portion of the surface on the p-type island. The relative position of the ohmic contact is shown at 16 also on the surface of the p-type island. The $n^+$ diffusion 14 is located where it may be easily connected, via the metal connection 20, to each Schottky barrier.

During operation, an infrared image is focussed onto the retina from the silicon substrate side (10). Each cell discharges in proportion to the intensity of the infrared signal that illuminates the Schottky diode resulting in a charge image on the retina. This charge image is readout by sweeping the retina cell by cell with an electron beam using techniques that are well known in the television art.

Referring now to FIG. 3, cell readout is shown where the electron beam 30 strikes the metal electrode 26 which makes contact with the ohmic contact pad 16. The effect of the electron beam is a negative bias voltage on the p-type island 12 with respect to the Schottky electrode 18 and the n-type substrate 10. The Schottky electrode 18 and its substrate contact buss 20 are shielded from the electron beam by insulator 24. During transit of the electron beam over the ohmic contact, a signal current passes through the substrate via the Schottky electrode and p-n junctions 32 to ground. The signal current can be observed at an external load resistor 34 connected between the substrate and ground. Following the electron beam transit, both the p-n junction and the Schottky junction are left floating at a reverse bias ($V_o$). In order to avoid the possible discharge of this bias by dark currents, the retina may be cooled. At a reduced temperature the only discharge mechanism is that caused at the photocathode by infrared photons of wavelength greater than one micrometer.

An equivalent circuit for the photoresponse mechanism and its readout can be seen in FIG. 4. At the end of each electron beam transit a voltage $V_o$ is left across the p-n and Schottky junctions. During exposure to an infrared scene this voltage is discharged by the incident infrared flux shown at 36 along the circuit path shown by arrows 38 and including capacitor 40 and resistor 42. At the termination of the exposure the diodes 44 and 46 are recharged to $V_o$ by the next electron beam transit. The recharge is along the circuit path shown by arrows 48 and include the electron beam represented at 50 the source of potential by 52 and external load resistor 34. As the diodes recharge, a video voltage is measured at node 54. This point is common to all cells of the retina whereby, as the electron beam moves from cell to cell or island to island, a continuous video signal is read across the single load resistor 34.

Retinas with higher sensitivity may be fabricated by applying an opaque insulator material (24) over the Schottky electrodes (18), or alternatively the metal of the p-island contact pad (20) could be allowed to cover the entire Schottky diode. This would allow simpler electron gun design due to the obscuration of the hot cathode from the retina.

It should be understood, of course, that the foregoing disclosure relates to only a preferred embodiment of the invention and that numerous modifications or alterations may be made therein without departing from the spirit and scope of the invention as set forth in the appended claims.

What is claimed is:

1. A solid state retina sensing layer for infrared vidicon tubes comprising a base having one conductivity type; a plurality of cells of a second conductivity type, arranged in a two dimensional array and forming junctions with said base, a contact formed near the surface of said cell; infrared photo-emitter means affixed to at least one surface of each cell; a plurality of contact means in said base located between said cells; buss means for connecting the photoemitter means with the base contact means; a dielectric coating covering the surface of the base receiving the electron beam, a metal electrode for each cell positioned on the surface of said dielectric coating and extending through the coating to the contact of said cell whereby electrons reaching the electrode will place a charge on the cell, and a resistance means connecting the base to ground potential where the amount of charge lost by the cell due to infrared radiation may be measured.

2. A solid state retina sensing layer for infrared vidicon tubes according to claim 1 wherein said base comprises a monolithic silicon wafer.

3. A solid state retina sensing layer for infrared vidicon tubes according to claim 2 wherein said monolithic silicon wafer base includes an n-type substrate.

4. A solid state retina sensing layer for infrared vidicon tubes according to claim 1 wherein each of said cells comprising a p-type silicon island formed in the base.

5. A solid state retina sensing layer for infrared vidicon tubes according to claim 1 wherein said infrared photoemitter is a Schottky electrode.

6. A solid state retina sensing layer for infrared vidicon tubes according to claim 1 wherein said dielectric coating is silicon dioxide.

* * * * *